United States Patent [19]

Isenga

[11] Patent Number: 4,969,073

[45] Date of Patent: Nov. 6, 1990

[54] TERRACED LIGHT

[75] Inventor: Steve Isenga, Zeeland, Mich.

[73] Assignee: ITC, Incorporated, Zeeland, Mich.

[21] Appl. No.: 439,266

[22] Filed: Nov. 20, 1989

[51] Int. Cl.[5] ..... F21V 17/02; F21V 11/00

[52] U.S. Cl. ..... 362/320; 362/361; 362/432

[58] Field of Search ..... 362/61, 320, 361, 432

[56] References Cited

U.S. PATENT DOCUMENTS 2,269,182 1/1942 Claspy et al. ..... 362/361

*Primary Examiner*—Allen M. Ostrager

*Attorney, Agent, or Firm*—Flynn, Thiel, Boutell & Tanis

[57] ABSTRACT

A light fixture, mountable on a wall, comprises a backing member and a support for a light emitter in front of the backing member, a shade member mountable on the backing member in a position to interfere with at least some of the light rays emanating from the light emitter forwardly of the backing member mounting structure for removably fixing the shade member on the backing member, the shade member comprising a substantially rigid band of forwardly convex and rearwardly concave shape having lateral ends releasably fixed to respective lateral ends of the backing member and having a central portion spaced forwardly of a central portion of the backing member and offset forwardly of the position of the light emitter, the shade member being elastically deformable to allow forcing a temporary resiliently resisted springing apart of its ends, the mounting structure enabling the corresponding lateral ends of the backing member and shade member to establish a releasable snap fit connections therebetween.

16 Claims, 4 Drawing Sheets

TERRACED LIGHT

FIELD OF THE INVENTION

This invention relates to a light fixture for mounting on a wall, for example in a recreational vehicle, boat cabin or the like.

BACKGROUND OF THE INVENTION

Wall mounted light fixtures, including those adapted for use in recreational vehicles or in the cabin of a boat, have been known for many years. However, as far as I am aware, such prior lamps are available only in fixed sizes and shapes and are not readily modifiable if a change in size or shape is desired after the lamp is installed. For various reasons, existing wall lamps have not been entirely satisfactory and it is the intention of Applicant to improve same.

Accordingly, the objects and purposes of the invention are met by providing a wall mountable lamp particularly adapted for mounting on walls, for example in a recreational vehicle or boat cabin, in which the light fixture is constructed of modular components that can be rearranged to create different appearances, in which shade modules of different widths can be assembled in various combinations, in which some assemblies of shade modules provide a "art deco" appearance, in which fasteners securing the light fixture to a wall are hidden, in which the invention is adaptable to different sizes and voltages of light bulbs (in a sense of light demanding bulbs, tubes, etc.), in which shade modules are positively but removably fixed and installed on backing plates by a snap fit action and without requiring tools, and in which the components thereof can be readily manufactured at low cost by molding from common plastics materials.

Further objects and purposes of the invention will be apparent to persons familiar with devices of this general kind upon reading the following description and inspecting the accompanying drawings.

SUMMARY OF THE INVENTION

Figure 2:
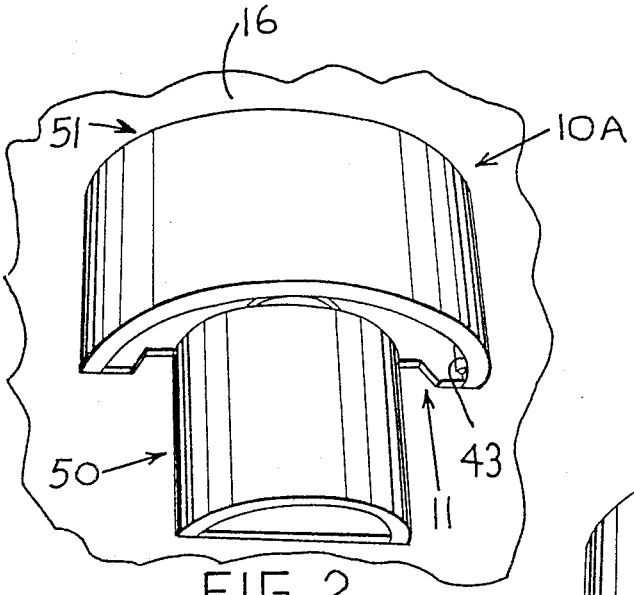
FIG. 2 is a pictorial view similar to FIG. 1 but showing a modification.

A light fixture, mountable on a wall, comprises a backing member and a support for a light emitter in front of the backing member, a shade member mountable on the backing member in a position to interfere with at least some of the light rays emanating from the light emitter forwardly of the backing member mounting structure for removably fixing the shade member on the backing member, the shade member comprising a substantially rigid band of forwardly convex and rearwardly concave shape having lateral ends releasably fixed to respective lateral ends of the backing member and having a central portion spaced forwardly of a central portion of the backing member and offset forwardly of the position of the light emitter, the shade member being elastically deformable to allow forcing a temporary resiliently resisted springing apart of its ends, the mounting structure enabling the corresponding lateral ends of the backing member and shade member to establish a releasable snap fit connection therebetween.

DETAILED DESCRIPTION

A light fixture 10, embodying the invention, comprises a generally T-shaped, substantially planar backing plate 11 (FIGS. 1, 6 and 8) comprising a lower narrower leg portion 12 and upper wider cross head portion 13. Mounting holes 14 and 15 (FIGS. 6 and 8) pierce the leg portion 12 and cross head portion of the backing plate. The backing plate 11 is removably mountable on an upstanding wall 16 by means of screws 20 and 21 inserted through the mounting holes 14 and 15, respectively, and threaded into the wall 16.

While the light fixture embodying the invention can be mounted in a variety of locations, including buildings, a particularly advantageous use is on interior wall surfaces of boat cabins and recreational vehicles.

Figure 6:
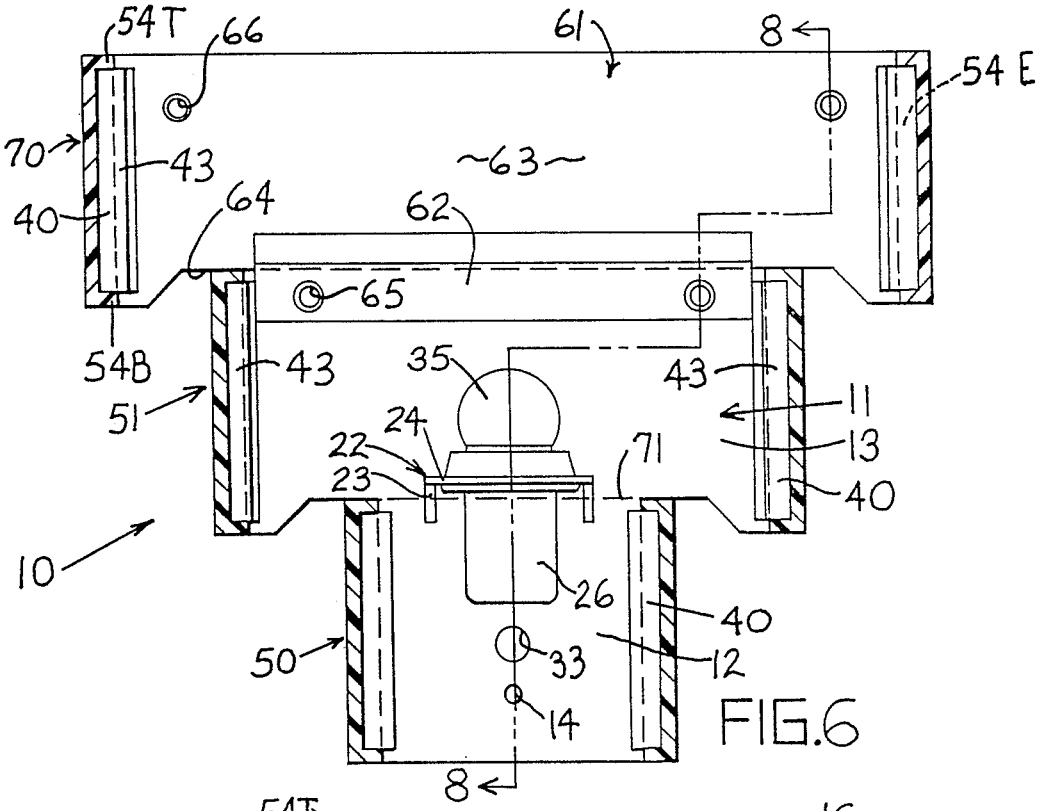
FIG. 6 is a cross-sectional view substantially taken on the line 6—6 of FIG. 5.

The leg and cross head portions 12 and 13 of the backing plate 11 are preferably bilaterally symmetrical about a vertical axis as seen in FIG. 6. Centered on this vertical central axis, as seen in FIG. 6, and preferably located just slightly above the top of the leg portion 12 and on the front face thereof, is a forward extending, horizontal, generally planar bracket 22 (FIGS. 6 and 8) fixed to the backing plate 11 and preferably integral therewith. The bracket comprises a planar horizontal shelf 24 protruding forward from the backing plate 11 and generally triangular braces 23 depending along the sides of the shelf 24 and fixed to the front face of the backing plate 11, preferably integrally, to raise the bracket 22 with respect to the backing plate 11. A central opening 25 (FIG. 8) in the shelf 24 receives therethrough a conventional electric bulb socket 26. The socket 26 is fixed to the shelf 24 here by means of a top flange 30 of the socket and a retaining ring 31 telescoped over the bottom portion of the socket 26 to sandwich therebetween the shelf 24 snugly to fix the socket on the shelf. The socket 26 is provided at its bottom with a conventional insulated conductor pair 32 which is remotely connectable to a switch and electric power source (not shown) by passing through a hole 33 (FIGS. 6 and 8) in the leg portion 12 of the backing plate 11, and thence through an aligned hole 34 in the wall 16.

A conventional bulb 35 is replaceably received in the socket 26 in a conventional manner, for the selectable ignition by the mentioned electric power source and switch (not shown). The bulb 35 is spaced somewhat forward of the backing plate 11 to avoid overheating the backing plate 11. In the embodiment shown, the bulb is a conventional 12 volt incandescent bulb of the kind conventionally used in boats and recreational vehicles. However, it is contemplated that the inventive light fixtures readily adapted to bulbs of other voltage ratings (e.g. 110 volts AC) and types (e.g. fluorescent).

Figure 11:
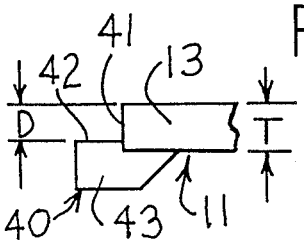
FIG. 11 is an enlarged fragmentary plan view looking down on the top of the buttress of FIG. 9.

The backing plate 11 includes, at each of the opposite lateral ends of the cross head portion 13 and at each of the opposite lateral ends of the leg portion 12, a forwardly offset, laterally extended flange 40 (FIGS. 6, 7 and 9) which extends beyond the corresponding cross head portion or leg portion lateral end 41 (FIG. 9) to define a rear facing step 42. In the embodiment shown, each flange 40 is a laterally outward extension of a platelike buttress 43 fixed to, and in the preferred embodiment shown integrally molded with, the front face of the backing plate 11. The buttress 43 here overlaps the backing plate 11 by a lateral extent which is at least twice the lateral extent of the step 42. In the embodiment shown, the flange 40 slightly rearwardly overlaps the lateral end 41 and is spaced from an extension of the rear plane of the backing plate 11 by a distance D (FIG. 11) slightly less than the thickness T of the central portion of the backing plate 11, for reasons appearing hereinafter. The buttress 43 and its laterally extending flange 40 are of height less than the adjacent lateral end of the leg portion 12 or cross head portion 13. Thus, the top and bottom of the buttress 43 are respectively spaced below and above, by an amount A, the respective top and bottom edges of the adjacent lateral end portion of the leg portion 12 or cross head portion 13 of the backing plate 11.

Figure 7:
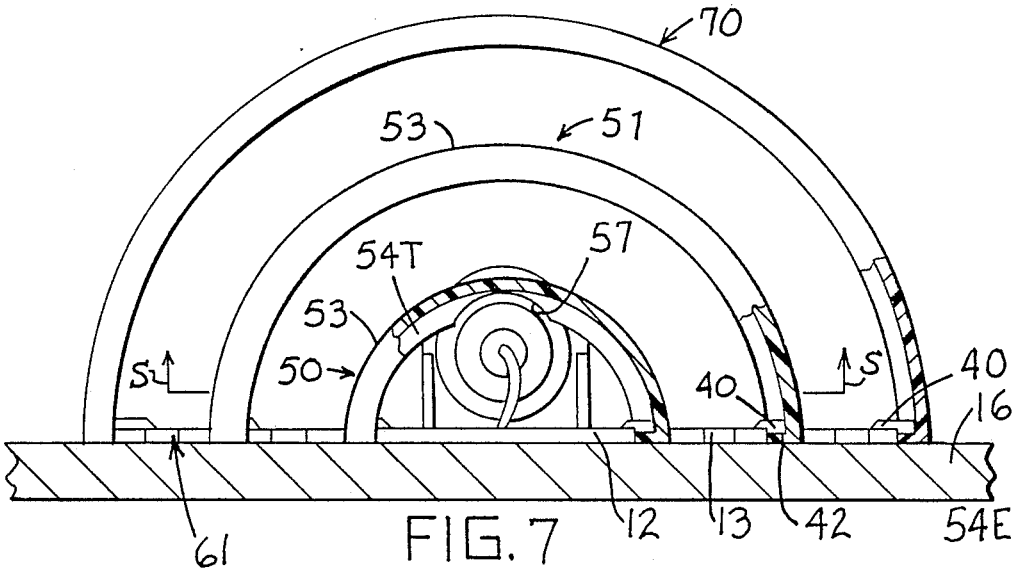
FIG. 7 is an enlarged, partially broken, bottom view of the FIG. 1 light fixture.

The light fixture 10 further includes at least one, and preferably two or more, shade members, for example respective small and medium width shade members 50 and 51 (FIGS. 1 and 4–9). In the embodiment shown, the shade members 50 and 51 each have the basic shape of a hemicircular (half circle) cylinder and more particularly each comprises a cylindrical half-circle side wall 52S and 52M respectively. While the particular half-circular cylinder shape is preferred and provides an interesting art deco appearance in the finished light fixture, it is also contemplated, within the broader aspects of the invention, that shade members of different shapes may be employed. For example, it may be desired to provide raised or relieved exterior decoration on a shade member convex outer face 53. Alternately, the constant radius, or semicircular (e.g. FIG. 7) shape of the shade members 50 and 51 can be substituted by generally convex shapes of non-constant radius, such as segments of ovals or ellipses, or generally convex shapes with corners or other discontinuities, such as portions of pentagons, hexagons and other pentagonal shapes (multi-sided shapes) having regularly or irregularly sized sides. Indeed, it is contemplated that even generally convex shapes may be made up of plural, laterally narrow, convex segments (providing a scalloped appearance). In any event, the shade members 50, 51 are each outwardly convex and inwardly (toward the backing plate 11) generally concave. Moreover, the shade members 50 and 51, though varying in radial or circumferential extent, are preferably of similar shape in plan and are coaxially arranged with respect to each other, as seen in FIG. 7. Moreover, the semicircular shape of the particular shade members 50 and 51 shown in the drawings is aesthetically pleasing, provides an interesting art deco appearance, is of maximum rigidity for the amount of material used, uses the minimum amount of material for a given size, provides a maximum light output for the selected radiuses of the shade members, and can be molded with relatively simply and inexpensive molds.

Each shade member 50, 51, in addition to its upstanding side wall 52S, 52M, respectively has a rearwardly, or radially inwardly projecting, perimeter flange 54 having laterally extending top and bottom flange portions 54T and 54B and generally vertically extending end portions 54E connecting the ends of the top and bottom portions 54T and 54B. The perimeter flanges 54 preferably are of rectangular, almost square, cross section, which in thickness approximates the thickness of the corresponding side wall 52S, 52M. The perimeter flange 54 helps to rigidify the generally rigid shade members 50, 51 and thus allows the side wall 52S, 52M thereof to be made thinner, so that each shade member 50, 51 can be constructed of less material than would otherwise be required for a given size and rigidity.

In addition, the width TW (FIG. 9) and thickness PT of the shade member perimeter flange 54 is selected to allow each perimeter flange end portions 54E to fit snugly behind the corresponding step 42 and substantially against the corresponding lateral end 41 of the corresponding portion of the backing plate 11, while the adjacent flange 40 is snugly received vertically between the top and bottom flange portions 54T and 54B of the shade member 50, 51, as shown in FIGS. 6–9.

Figure 8:
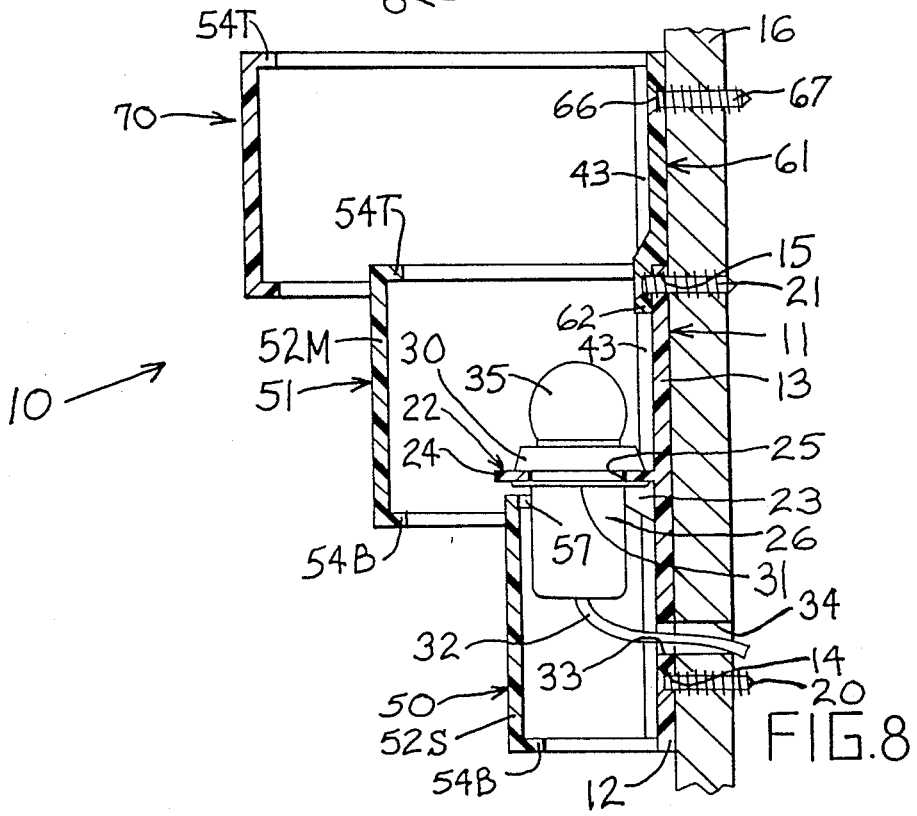
FIG. 8 is a cross-sectional view substantially taken on the line 8—8 of FIG. 6.

When installed on the backing plate in the manner shown in FIGS. 6–8, each upstanding perimeter flange portion 54E of a shade member 50, 51 is thus slidably and snugly trapped between the adjacent flange 40 of the backing plate 11 and the wall 16 upon which the backing plate 11 is fixed. In this manner the two lateral ends of each shade member 50, 51 are fixed against forward and rearward motion. Similarly, each shade member flange 40 is trapped snugly but slidably between the top and bottom perimeter flange portions 54T and 54B of the corresponding end of the corresponding shade member 50, 51, so that the shade member 50, 51 cannot move vertically with respect to the backing plate 11. The shade member 50, 51 is sufficiently rigid so that its lateral ends (and hence its perimeter flange upstanding end portions 54E) cannot by themselves move laterally away from each other and hence tend each to stay in the pocket formed by the corresponding step 42 and backing plate lateral end 41 (FIG. 9) of the adjacent portion of the backing plate 11 and wall 16. Thus, the shade members 50, 51 are fixed on the backing plate 11 by their intrinsic resilient resistance to deformation in a kind of snap fit relation. Accordingly, there are no separate fastening elements, such as screws or the like, securing the shade members 50, 51 to the backing plate 11, there is no need to try to hide or disguise separate fastening elements to satisfy aesthetic considerations, nor is there any need for tools to attach or detach each shade member 50, 51 with respect to the backing plate 11.

Figure 9:
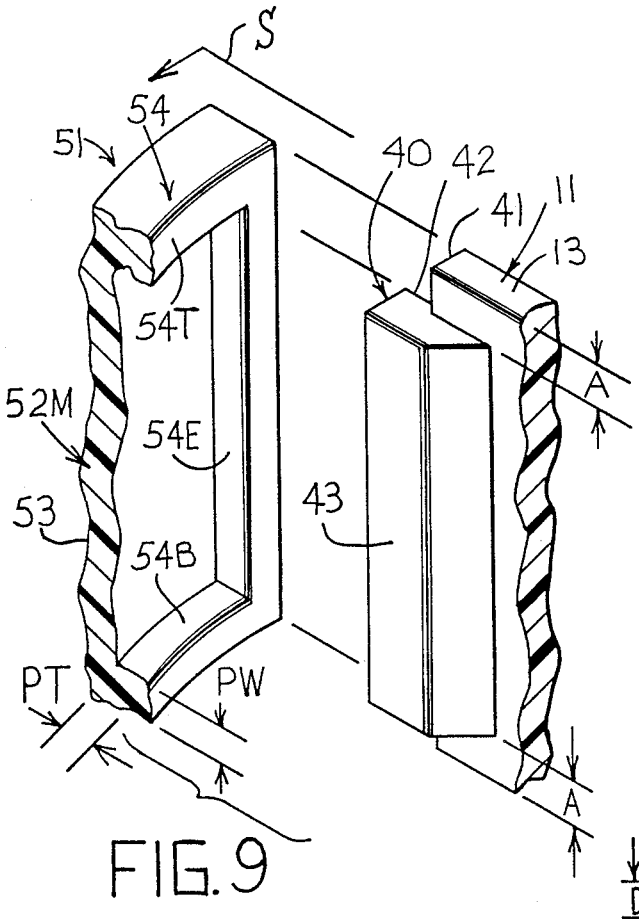
FIG. 9 is a fragmentary, enlarged, exploded, pictorial view showing the connection of adjacent ends of a backing plate and shade module of the FIG. 1 light fixture.

Each shade member, for example shade member 51 (FIGS. 7 and 9), can be removed from the backing plate 11 by pulling its lateral ends and perimeter flange portions 54E laterally apart, beyond the adjacent backing plate flanges 40, and hence laterally away from the backing plate 11, and then moving the shade member forwardly away from the backing plate, generally in the direction of the arrows S in FIGS. 7 and 9. Once removed from the backing plate 11, the shade member 51 can be allowed to spring back into its rest shape generally indicated in FIGS. 1 and 7.

Installing a shade member 50, 51 on the backing plate 11 is accomplished by reversal of the foregoing steps, namely by pulling apart the lateral ends of the shade member sufficient to allow the perimeter flange end portions 54E thereof to slide rearwardly past the corresponding backing plate flanges 40 and then allowing the shade member 50, 51 to resiliently return it to its set rest shape, with its upstanding perimeter flange end portions 54E each trapped in the upstanding pocket between the adjacent flange 40 and the wall 16. The relaxed shade member thus resiliently laterally grips between its ends the opposite lateral ends of the backing plate 11, as seen in FIGS. 1 and 4–9. All the shade members are preferably installable on and removable from corresponding backing plate in the same manner as above described with respect to shade member 51.

In the preferred embodiment shown in FIGS. 6 and 8, the small shade member 50 covers the lamp socket 26, extending downward from just below the shelf 24. The medium shade member 51 extends both above and below the light bulb 35 to shade the direct forward horizontal glare of the ignited light bulb 35. The shade members 50 and 51 slightly overlap vertically to provide a terraced effect and also to make sure that the socket and shelf are not visible to casual observation horizontally or substantially horizontally toward the light fixture 10. To accommodate this vertical overlap of the shade members 50 and 51, the bottom edge of the cross head portion 13 of the backing plate 11 is upwardly recessed to 56 (FIG. 6) from a location spaced inboard of the lateral end flanges 40 and inboard to where the leg portion 12 depends from the cross head portion 13 of the backing plate 11.

Figure 1:
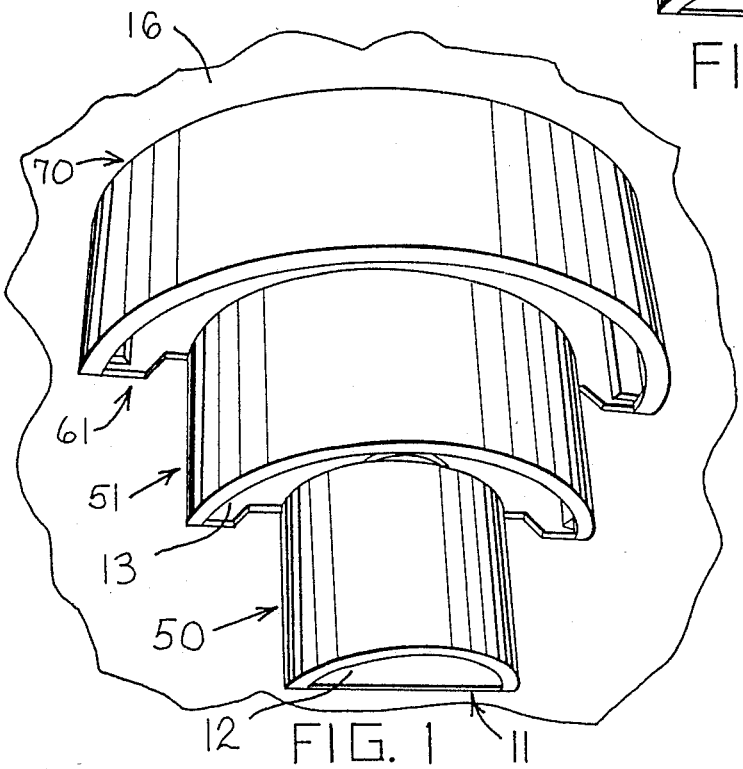
FIG. 1 is a pictorial view of a light fixture embodying the invention.
Figure 4:
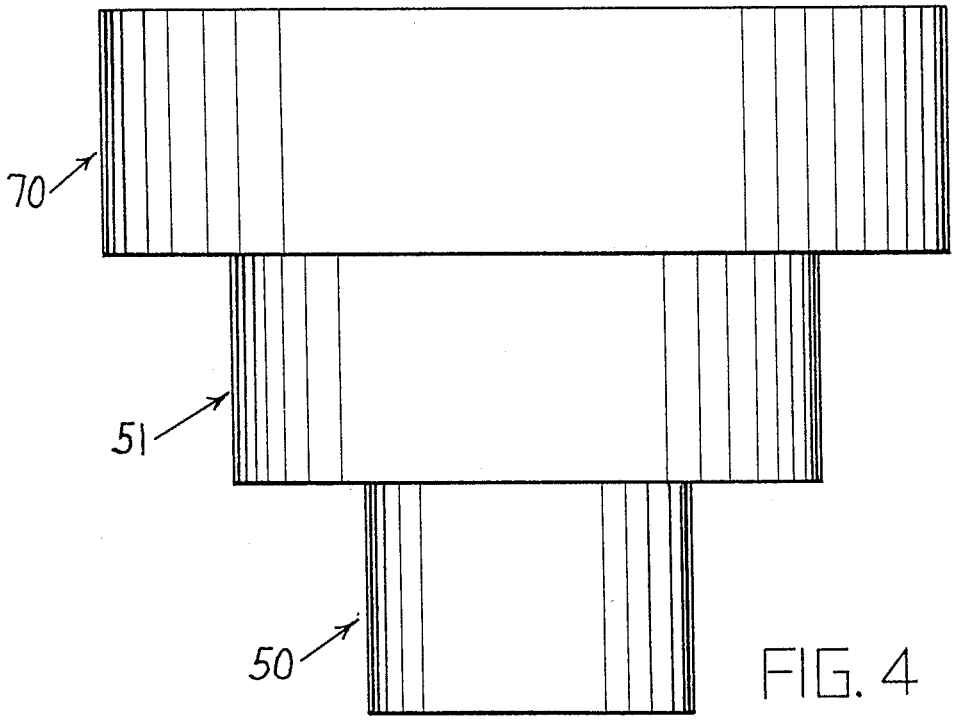
FIG. 4 is an enlarged front view of the FIG. 1 light fixture.
Figure 5:
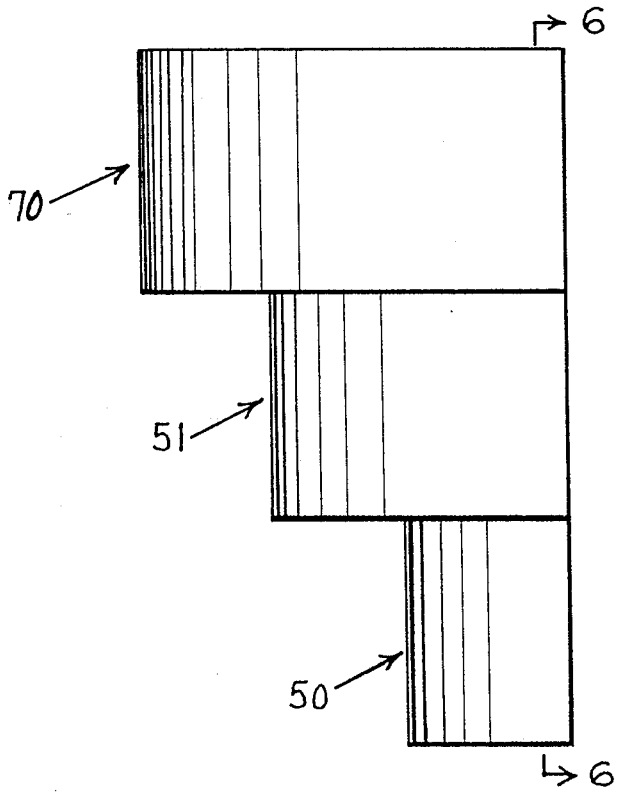
FIG. 5 is an enlarged, right side, elevational view of the FIG. 1 light fixture.

The foregoing describes the middle and bottom portions of the light fixture 10 of FIG. 1. That described structure can be used by itself to form a smaller fixture 10A as shown in FIG. 2, namely one having two different sized (here small and medium) shade members 50, 51 secured on a backing member 11, in turn fixed to a wall 16.

In the embodiment shown in FIGS. 7 and 8, the top flange 54T of the small shade member 50 has a centrally located, rear facing, semi-circular relief 57 to provide clearance for the socket 26.

The three tier light fixture 10 of FIG. 1 is completed as follows. A backing plate extension 61 (FIGS. 1 and 6–8) preferably corresponds in height to the cross head portion 13 and leg portion 12, but is wider laterally. In the preferred embodiment shown, the backing plate extension 61 is laterally centered on the backing plate 11 and the backing plate extension 61 steps laterally beyond the cross head portion 13 by the same amount the cross head portion steps laterally beyond the leg portion 12. A laterally extending buttress 62 is fixed, preferably integrally, to the central portion of the front face 63 of the backing plate extension 61 and depends below the central lower edge 64 of the backing plate extension 61. The central lower edge 64 of the backing plate extension 61 is preferably recessed as above described with respect to the recess 56 in the central lower edge of the cross head 13 of the backing plate 11, and for the same reason, namely to permit a vertical overlap of shade members as hereafter discussed.

The buttress 62 overlaps the upper front face portion of the cross head portion 13 of the backing plate 11, when the recessed lower edge 64 of the backing plate extension 61 rests atop the upper edge of the backing plate 11 in a laterally centered manner, as shown in FIGS. 6 and 8. The lateral width of the buttress 62 is such that it fits snugly between the laterally spaced end buttresses 43 on the cross head portion 13 of the backing plate 11, so as to help laterally center the backing plate extension 61 on the top of the backing plate 11.

Mounting holes 65 through the depending portion of the bulkhead 62 are coaxial continuations of the mounting holes 15 along the upper edge portion of the backing plate 11. In the embodiment shown, the backing plate extension is provided with additional mounting holes 66 near its upper edge. Thus the mounting plate extension 61 is fixed removably to the wall 16 immediately above the backing plate 11 by passing the screws 21 through the coaxially aligned holes at 65 and 15 in the respective plates 61 and 11 into the wall 16 and by passing the screws 67 through the holes 66 in the backing plate extension 61 into the wall 16.

The lateral end portions of the extension 61 are equipped with buttresses 43 in the same manner as above described with respect to the cross head portion 13 and leg portion 12 of backing plate 11, and as shown in enlarged detail in FIG. 9.

A large shade member 70 (FIGS. 1 and 6–8) is preferably shaped similar to the shade members 50 and 51, is here of similar height thereto, and is of lateral width corresponding to the lateral width of the backing plate extension 61 (and hence of greater lateral width than the medium shade member 51). The structure of the large shade member 70 is otherwise similar to that above-described with respect to shade members 50 and 51. The large shade member 70 thus is releasably fixable to the backing plate extension 61 in the same manner that the shade members 50 and 51 are fixed to their respective leg portion 12 and cross head portion 13 of the backing plate 11.

Figure 3:
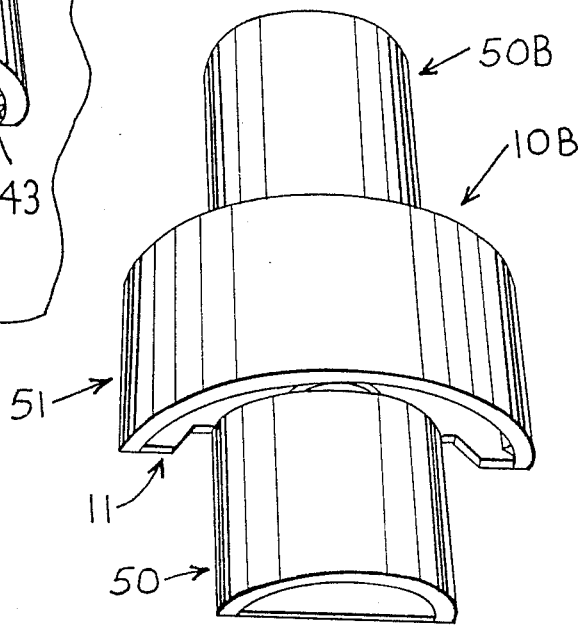
FIG. 3 is a pictorial view similar to FIG. 1 but showing a further modification.
Figure 10:
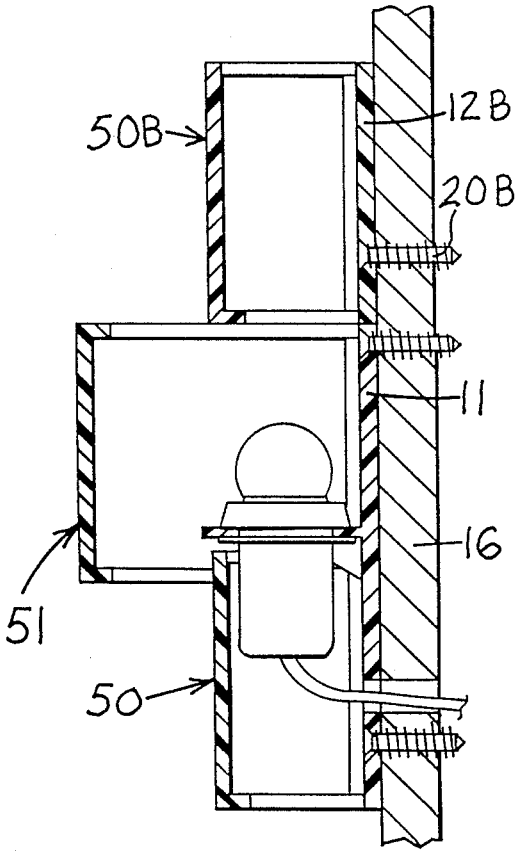
FIG. 10 is a cross-sectional view similar to FIG. 8, but of the FIG. 3 modified light fixture.

Turning now to FIG. 3, a modified light fixture 10B is similar to the FIG. 2 light fixture 10A, except for the addition of a second small shade member 50B (FIGS. 3 and 10) modified backing plate extension 12B hereafter described. In the embodiment shown, the backing plate extension 12B simply corresponds to an extra leg portion 12 (FIG. 6) obtainable by cutting off the bottom portion of an extra backing plate 11, below the dotted line 71. In the embodiment shown, the modified backing plate extension 12B sits atop the top edge of the backing plate 11 as seen in FIG. 10 and is secured by an extra screw 20B to the wall 16. If desired, additional holes can be bored through the backing plate extension 12B to allow extra screws (not shown) to be driven through to the wall 16. In the FIG. 10 modification, the second small shade member 50B is located immediately above the medium shade member 50. The second small shade member 50B is releasably fixed to the backing plate extension **12*b* in exactly the manner above-described with respect to the small shade member 50 of FIG. 1 and FIGS. 6–8**.

FIGS. 1, 2 and 3 thus show three possible variations of the inventive light fixture wherein backing plates and backing plate extensions and different shade members of desired widths are combined to provide different light fixture appearances and light distribution characteristics. The different shade members, backing plates and backing plate extensions above described can be combined in different ways to provide lamp appearances different from and additional to those shown by way of example in FIGS. 1–3. The present invention thus provides for modular lamp constructions, in which the differing shade members and backing plate and backing plate extensions are modules combinable in different ways to achieve a number of different light fixture appearances, without having to stock a corresponding number of different light fixtures.

The above described shade members and backing plate and backing plate extensions are preferably constructed of substantially rigid molded plastics materials such as, for example, polycarbonate, although construction with various materials is possible. The parts can be of desired color, surface texture, etc. If desired, the shade members may be of opaque, translucent, or even transparent material. The surfaces of the shade members and backing plate and backing plate extensions which face the light bulb can be made more or less reflective to help control the emission of light from the light fixture.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A light fixture mountable on a wall, comprising:

backing plate means and means for supporting a light emitter in front of said backing plate;

a shade member mountable on the backing plate means in a position to interfere with at least some of the light rays emanating from the light emitter forwardly of the backing member;

mounting means for removably fixing said shade member on said backing plate means, said shade member comprising a substantially rigid band of forwardly convex and rearwardly concave shape having lateral ends releasably fixed to respective lateral ends of the backing member and having a central portion spaced forwardly of a central portion of the backing plate means and offset forwardly of the position of the light emitter, said forwardly convex shade member being laterally outwardly elastically deformable to allow forcing a temporary resiliently resisted springing apart of its said ends, said mounting means comprising cooperative means at the corresponding lateral ends of the backing plate means and shade member for establishing a releasable snap fit of said shade member over the lateral ends of the base plate means, said cooperative means comprising laterally outwardly extending flanges at the outer lateral ends of the backing plate means, said flanges being spaced forwardly from and cooperating with a wall on which the backing plate means is mounted to define respective oppositely laterally outwardly facing pockets, said cooperative means further including a laterally inwardly protruding flange on each lateral end portion of the shade member and resiliently laterally inwardly urged snugly into said pockets upon allowing said shade member ends to spring toward each other, for laterally hiding the laterally outer ends of said backing plate means by surrounding thereof by said shade member and particularly the lateral end portions of the shade member.

2. The apparatus of claim 1 in which said cooperative means further includes laterally inwardly protruding flange means on said shade member and abutting horizontal surface means on said backing plate means for positively blocking vertical movement of said shade member with respect to said backing plate means.

3. The apparatus of claim 1 including a second said shade member, said two shade members being of different lateral width and forward/rearward extent, said backing plate means having upper and lower portions of different lateral width, corresponding to the differing lateral widths of the two shade members, said shade members being independently fixed to the correspondingly different width portions of the backing plate means each by their own said cooperative means, such that the mounting of one shade member on the backing plate means is independent of mounting of the other shade member thereon.

4. The apparatus of claim 1 in which the shade member comprises a vertically and laterally extending side wall and a substantially continuous perimeter flange protruding rearwardly and laterally inwardly from the concave side of the sidewall, said side wall and perimeter flange defining said substantially rigid band, vertical portions of said perimeter flange near the lateral ends of said shade member forming a portion of said cooperative means for establishing said releasable snap fit connection with said corresponding lateral ends of the backing plate means, horizontal portions of said perimeter flange engaging the backing plate means near the laterally outer ends to vertically fix the shade member on the backing plate means.

5. A light fixture mountable on a wall, comprising:

backing plate means and means for supporting a light emitter in front of said backing plate;

a shade member mountable on the backing plate means in a position to interfere with at least some of the light rays emanating from the light emitter forwardly of the backing member;

mounting means for removably fixing said shade member on said backing plate means, said shade member comprising a substantially rigid band of forwardly convex and rearwardly concave shape having lateral ends releasably fixed to respective lateral ends of the backing member and having a central portion spaced forwardly of a central portion of the backing plate means and offset forwardly of the position of the light emitter, said shade member being elastically deformable to allow forcing a temporary resiliently resisted springing of its said ends, said mounting means comprising cooperative means at the corresponding lateral ends of the backing plate means and shade member for establishing a releasable snap fit connection therebetween, said cooperative means further including laterally inwardly protruding flange means on said shade member and abutting horizontal surface means on said backing plate means for positively blocking vertical movement of said shade member with respect to said backing plate means.

6. A light fixture mountable on a wall, comprising:

backing plate means and means for supporting a light emitter in front of said backing plate;

a shade member mountable on the backing plate means in a position to interfere with at least some of the light rays emanating from the light emitter forwardly of the backing member;

mounting means for removably fixing said shade member on said backing plate means, said shade member comprising a substantially rigid band of forwardly convex and rearwardly concave shape having lateral ends releasably fixed to respective lateral ends of the backing member and having a central portion spaced forwardly of a central portion of the backing plate means and offset forwardly of the position of the light emitter, said shade member being elastically deformable to allow forcing a temporary resiliently resisted springing of its said ends, said mounting means comprising cooperative means at the corresponding lateral ends of the backing plate means and shade member for establishing a releasable snap fit connection therebetween, the backing plate means comprising a T-shaped backing plate, a second shade member, the first-mentioned and second shade members being of different lateral width, corresponding to the differing lateral width of the top and bottom portions of the T-shaped backing plate, said two shade members being mounted on said T-shaped backing plate to provide a terraced appearance.

7. The apparatus of claim 6 in which said two shade members are vertically offset with one extending upward from the other, the larger shade member protruding beyond the smaller laterally, and forwardly to create a substantially horizontal gap, the gap being located such that light rays from the light emitter can escape therethrough to illuminate an area ahead of the wall.

8. The apparatus of claim 7 in which the two shade members vertically overlap.

9. The apparatus of claim 6 in which the third shade member vertically stacked with respect to the first mentioned and second shade members, so that the three shade members are vertically stacked with respect to each other.

10. The apparatus of claim 9 in which said backing plate means further includes a backing plate extension fixed atop said T-shaped backing plate, said third shade member being mounted on said backing plate extension, said shade members presenting a terraced appearance.

11. The apparatus of claim 10 in which the three shade members are of progressively larger lateral width and forward extent from the backing plate means, to create a light fixture of terraced shape.

12. The apparatus of claim 10 in which two of the shade members are of relatively small lateral and forward extent and the remaining shade member is of greater lateral and forward extent and is vertically sandwiched between the two smaller shade members in a generally vertically symmetrical manner.

13. The apparatus of claim 6 in which said means for supporting a light emitter comprises a socket for supporting a light bulb, one said shade member of lesser lateral width extending around said socket for hiding same, and the other said shade member of greater lateral width extending forwardly around the light bulb location defined by the socket so as to be interposed between the light bulb location and areas in front of the light fixture, a semi-annular space forwardly and laterally between the smaller and larger shade members permitting escape of light from the light fixture.

14. The apparatus of claim 8 in which the bottom edge of the top part of said T-shaped backing plate is relieved laterally inboard of the outer lateral ends of said top part, such that the outer lateral ends of said bottom part overlap vertically with the outer lateral ends of the top part, the vertical extent of the outer lateral ends of each said part of said T-shaped backing plate corresponding substantially to the vertical extent of the lateral ends of the corresponding shade member fixed thereto, to assure said vertical overlap of said shade members.

15. A light fixture mountable on a wall, comprising:

backing plate means and means for supporting a light emitter in front of said backing plate;

a shade member mountable on the backing plate means in a position to interfere with at least some of the light rays emanating from the light emitter forwardly of the backing member;

mounting means for removably fixing said shade member on said backing plate means, said shade member comprising a substantially rigid band of forwardly convex and rearwardly concave shape having lateral ends releasably fixed to respective lateral ends of the backing member and having a central portion spaced forwardly of a central portion of the backing plate means and offset forwardly of the position of the light emitter, said shade member being elastically deformable to allow forcing a temporary resiliently resisted springing of its said ends, said mounting means comprising cooperative means at the corresponding lateral ends of the backing plate means and shade member for establishing a releasable snap fit connection therebetween, the backing plate means comprising a T-shaped backing plate, a second shade member, the first-mentioned and second shade members being of different lateral width, corresponding to the lateral width of the wider top and narrower bottom portions of the T-shaped backing plate, said two shade members being mounted on said T-shaped backing plate to provide a terraced appearance, said backing plate means further including a backing plate extension means and a third shade member mounted thereon, said shade members presenting a terraced appearance.

16. A light fixture mountable on a wall, comprising:

backing plate means and means for supporting a light emitter in front of said backing plate;

a shade member mountable on the backing plate means in a position to interfere with at least some of the light rays emanating from the light emitter forwardly of the backing member;

mounting means for removably fixing said shade member on said backing plate means, said shade member comprising a substantially rigid band of forwardly convex and rearwardly concave shape having lateral ends releasably fixed to respective lateral ends of the backing member and having a central portion spaced forwardly of a central portion of the backing plate means and offset forwardly of the position of the light emitter, said shade member being elastically deformable to allow forcing a temporary resiliently resisted springing of its said ends, said mounting means comprising cooperative means at the corresponding lateral ends of the backing plate means and shade member for establishing a releasable snap fit connection therebetween, the shade member comprising a vertically and laterally extending side wall and a perimeter flange protruding rearwardly and laterally inwardly from the concave side of the sidewall, said side wall and perimeter flange defining said substantially rigid band, said cooperative means including a buttress at each lateral end of said backing plate means, said buttress protruding laterally beyond said backing plate means to snugly but slidably enter a vertical space between top and bottom portions of said perimeter flange on the adjacent end of said shade member to thereby prevent vertical movement of the shade member with respect to the backing plate means, said buttress being of lesser height than said shade member, said shade member and the corresponding adjacent lateral end of said backing plate means being of substantially the same height so that their top and bottom surfaces are substantially flush with each other, said buttress being forwardly spaced from the back plane of said backing plate means to form, with a wall on which the backing plate means is mounted, a laterally outwardly facing pocket which is sized to snugly but slidably receive a generally vertically extending portion of the perimeter flange at the adjacent end of the shade member to positively prevent forward movement of the shade member with respect to the backing plate means.

* * * * *

UNITED STATES PATENT AND TRADEMARK OFFICE

CERTIFICATE OF CORRECTION

PATENT NO. : 4 969 073

DATED : November 6, 1990

INVENTOR(S) : Steve Isenga

It is certified that error appears in the above-identified patent and that said Letters Patent is hereby corrected as shown below:

Col. 9, line 53: after "extending" insert ---forwardly---.

Signed and Sealed this

Seventh Day of December, 1993

Bruce Lehman

*Attest:*

BRUCE LEHMAN

*Attesting Officer*

*Commissioner of Patents and Trademarks*